US011719230B2

(12) United States Patent
Garcia et al.

(10) Patent No.: US 11,719,230 B2
(45) Date of Patent: Aug. 8, 2023

(54) WELL SERVICING PUMP WITH ELECTRIC MOTOR

(71) Applicant: STEWART & STEVENSON LLC, Houston, TX (US)

(72) Inventors: Filiberto Garcia, Houston, TX (US); Chris Harvell, Houston, TX (US); Chad Joost, Houston, TX (US); Brian Sharp, Houston, TX (US); Paul Smith, Houston, TX (US)

(73) Assignee: STEWART & STEVENSON LLC, Houston, TX (US)

( * ) Notice: Subject to any disclaimer, the term of this patent is extended or adjusted under 35 U.S.C. 154(b) by 77 days.

(21) Appl. No.: 17/098,137

(22) Filed: Nov. 13, 2020

(65) Prior Publication Data

US 2021/0148348 A1 May 20, 2021

Related U.S. Application Data

(60) Provisional application No. 62/935,542, filed on Nov. 14, 2019.

(51) Int. Cl.

| | |
|---|---|
| ***F04B 17/03*** | (2006.01) |
| ***F04B 53/08*** | (2006.01) |
| ***F04B 47/02*** | (2006.01) |
| ***E21B 43/26*** | (2006.01) |
| ***F04B 53/00*** | (2006.01) |

(52) U.S. Cl.

CPC ..... *F04B 17/03* (2013.01); *E21B 43/2607* (2020.05); *F04B 47/02* (2013.01); *F04B 53/006* (2013.01); *F04B 53/08* (2013.01)

(58) Field of Classification Search

None

See application file for complete search history.

(56) References Cited

U.S. PATENT DOCUMENTS

| | | | | |
|---|---|---|---|---|
| 7,552,903 | B2 | 6/2009 | Dunn et al. | |
| 8,607,930 | B2 | 12/2013 | Stewart | |
| 8,789,601 | B2 | 7/2014 | Broussard et al. | |
| 9,410,410 | B2 | 8/2016 | Broussard et al. | |
| 9,650,879 | B2 | 5/2017 | Broussard et al. | |
| 9,893,500 | B2 | 2/2018 | Oehring et al. | |
| 11,313,359 | B2 * | 4/2022 | Buckley | F04B 9/02 |
| 2009/0092510 | A1 * | 4/2009 | Williams | F04B 1/00 417/521 |
| 2015/0104287 | A1 | 4/2015 | Ryan | |

(Continued)

*Primary Examiner* — Matthew Troutman
*Assistant Examiner* — Douglas S Wood
(74) *Attorney, Agent, or Firm* — Ewing & Jones, PLLC

(57) ABSTRACT

A well servicing pump system for a hydraulic fracturing system includes a first permanent magnet motor, second permanent magnet motor, and crankshaft. The first and second permanent magnet motors each include a rotor mechanically coupled to or integrated with the crankshaft. The well servicing pump may include gearboxes coupled between the rotors and the crankshaft. The well servicing pump system also includes a fluid section that includes an inlet, a pressurization chamber, and an outlet. The inlet and outlet are fluidly coupled to the pressurization chamber. The well servicing pump also includes a plunger mechanically coupled to the crankshaft, the plunger at least partially positioned within the pressurization chamber.

12 Claims, 8 Drawing Sheets

(56) References Cited

U.S. PATENT DOCUMENTS

| | | | | |
|---|---|---|---|---|
| 2015/0275891 | A1* | 10/2015 | Chong | F04B 53/147 417/419 |
| 2016/0161188 | A1* | 6/2016 | Chong | E21B 43/2607 165/157 |
| 2017/0201141 | A1* | 7/2017 | Rollins | F28C 1/00 |
| 2019/0154020 | A1 | 5/2019 | Glass | |
| 2019/0309583 | A1* | 10/2019 | Netecke | E21B 19/008 |
| 2020/0109616 | A1 | 4/2020 | Oehring et al. | |
| 2020/0109617 | A1 | 4/2020 | Oehring et al. | |
| 2020/0263528 | A1 | 8/2020 | Fischer et al. | |
| 2020/0325760 | A1 | 10/2020 | Markham | |
| 2020/0378232 | A1 | 12/2020 | Sharp et al. | |
| 2021/0131411 | A1 | 5/2021 | Oehring et al. | |

* cited by examiner

WELL SERVICING PUMP WITH ELECTRIC MOTOR

CROSS-REFERENCE TO RELATED APPLICATIONS

This application is a nonprovisional application which claims priority from U.S. provisional application No. 62/935,542, filed Nov. 14, 2019, which is hereby incorporated by reference herein in its entirety.

TECHNICAL FIELD/FIELD OF THE DISCLOSURE

The present disclosure relates generally to enhanced recovery for wellbores, and specifically to hydraulic fracturing systems.

BACKGROUND OF THE DISCLOSURE

Industrial pumps are utilized to transfer fluids from one location to another and may be used in a wide variety of applications. For example, in the oil and gas industry, industrial pumps may be utilized for transferring production fluids, drilling mud, wastewater, hydraulic fracturing fluid, or other process fluids.

Hydraulic fracturing is a process utilized in oil and gas operations to enhance recovery of minerals from a reservoir within a subterranean formation. More specifically, hydraulic fracturing involves the injection of a pressurized fluid, referred to as "fracturing fluid" into a well in order to open, generate, and/or propagate fractures or cracks within the subterranean formation. The cracks formed by the pressurized fluid increase the volume of the reservoir, which enables the release of additional minerals and improves flow of the minerals from the reservoir to the surface via the well.

Fracturing fluid, which is typically a mixture of water, gel, foam, proppant (such as sand), and/or other materials, is injected into the well via hydraulic fracturing equipment. The hydraulic fracturing equipment may include a variety of components, such as material storage tanks, blenders for mixing the fracturing fluid, and pump systems configured to increase the pressure of the fracturing fluid before the fracturing fluid is injected into the well. Traditionally, a well servicing pump system includes a well servicing pump that is driven by a combustion engine, such as a diesel engine. For example, a diesel engine may be operatively connected to a well servicing pump via a geared transmission. Generally, diesel engines usually have a large footprint, generate undesirable noise and vibrations, increase environmental impact, and can be costly to operate. Additionally, driving a well servicing pump with a diesel engine may involve the utilization of numerous moving parts, which may increase operating and/or maintenance costs of the hydraulic fracturing equipment.

SUMMARY

The present disclosure provides for a well servicing pump system. The well servicing pump system may include a first permanent magnet motor, the first permanent magnet motor including a first rotor. The well servicing pump system may include a second permanent magnet motor, the second permanent magnet motor including a second rotor. The well servicing pump system may include a crankshaft. The crankshaft may be directly coupled to the first rotor and the second rotor such that the first rotor is coupled to the crankshaft at a first end of the crankshaft and the second rotor is coupled to the crankshaft at a second end of the crankshaft. The well servicing pump system may include a fluid section. The fluid section may include an inlet, a pressurization chamber, and an outlet, the inlet and outlet fluidly coupled to the pressurization chamber. The well servicing pump system may include a plunger, the plunger mechanically coupled to the crankshaft, the plunger at least partially positioned within the pressurization chamber.

The present disclosure also provides for a hydraulic fracturing system. The hydraulic fracturing system may include a hydration system. The hydraulic fracturing system may include a blender system, the blender system configured to receive a fluid flow from the hydration system. The hydraulic fracturing system may include a well servicing pump. The well servicing pump may include a first permanent magnet motor, the first permanent magnet motor including a first rotor. The well servicing pump may include a second permanent magnet motor, the second permanent magnet motor including a second rotor. The well servicing pump may include a crankshaft. The crankshaft may be directly coupled to the first rotor and the second rotor such that the first rotor is coupled to the crankshaft at a first end of the crankshaft and the second rotor is coupled to the crankshaft at a second end of the crankshaft. The well servicing pump may include a fluid section. The fluid section may include an inlet, a pressurization chamber, and an outlet, the inlet and outlet fluidly coupled to the pressurization chamber. The well servicing pump may include a plunger, the plunger mechanically coupled to the crankshaft, the plunger at least partially positioned within the pressurization chamber. The inlet of the fluid section of the well servicing pump may be configured to receive fracturing fluid from the blender system. The outlet of the fluid section may be fluidly coupled to a well.

The present disclosure also provides for a well servicing pump system. The well servicing pump system may include a first permanent magnet motor, the first permanent magnet motor including a first rotor. The well servicing pump system may include a second permanent magnet motor, the second permanent magnet motor including a second rotor. The well servicing pump system may include a crankshaft. The well servicing pump system may include a first gearbox, the first gearbox operatively coupled between the first rotor of the first permanent magnet motor and the crankshaft at a first end of the crankshaft. The well servicing pump system may include a second gearbox, the second gearbox operatively coupled between the second rotor of the second permanent magnet motor and the crankshaft at a second end of the crankshaft. The well servicing pump system may include a fluid section, the fluid section including an inlet, a pressurization chamber, and an outlet. The inlet and outlet may be fluidly coupled to the pressurization chamber. The well servicing pump system may include a plunger. The plunger may be mechanically coupled to the crankshaft. The plunger may be at least partially positioned within the pressurization chamber.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION

Figure 1:
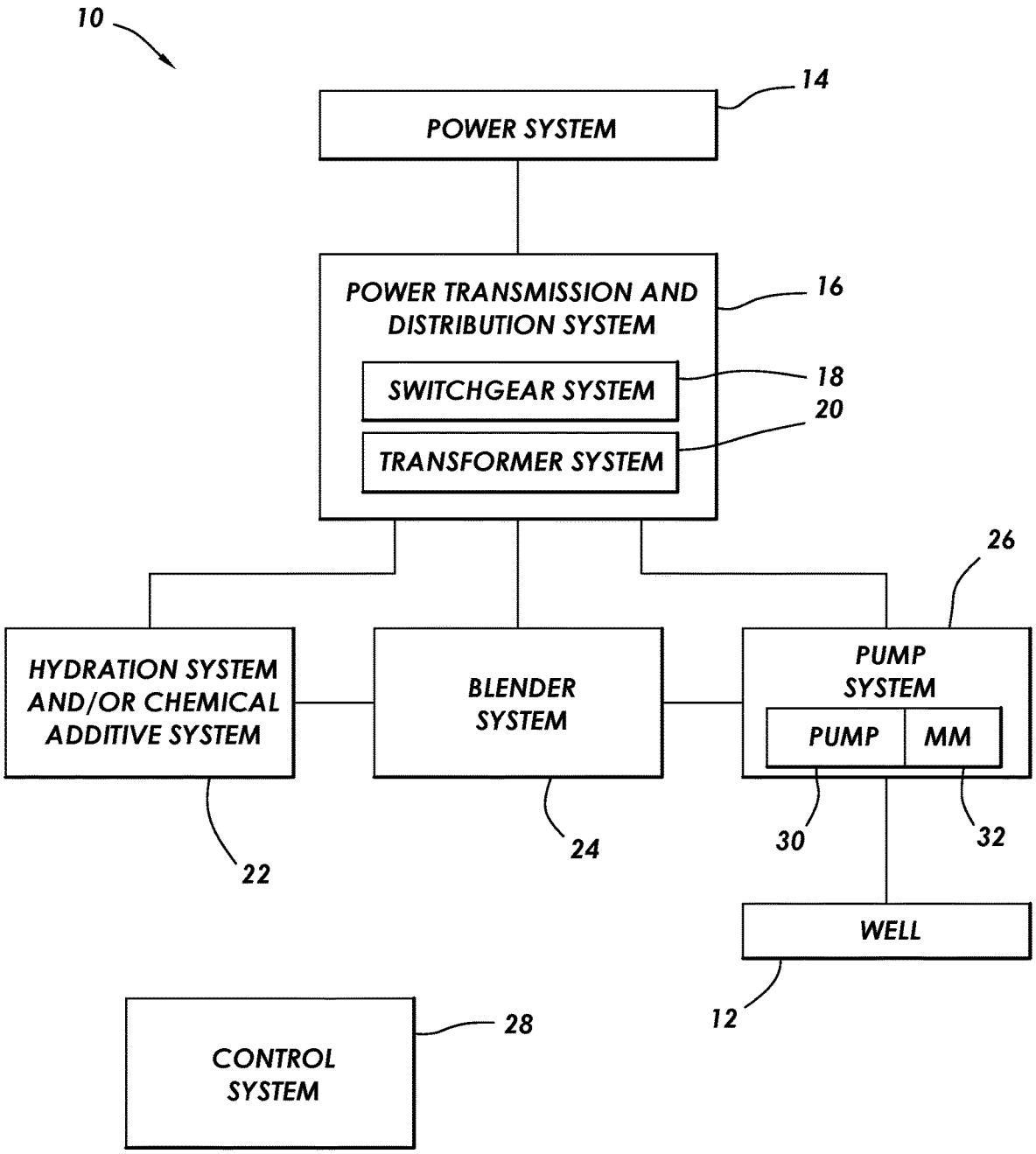
FIG. 1 is a schematic of an embodiment of a hydraulic fracturing system, in accordance with an aspect of the present disclosure.

It is to be understood that the following disclosure provides many different embodiments, or examples, for implementing different features of various embodiments. Specific examples of components and arrangements are described below to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed.

FIG. 1 depicts a schematic of an embodiment of hydraulic fracturing system 10 such as, for example and without limitation, a well servicing pump system, which may be utilized to provide pressurized fracturing fluid to well 12 during wellbore operations. Although the present disclosure describes pump system 26, as discussed below, in the context of a hydraulic fracturing system, it should be appreciated that the disclosed techniques may be applied to a variety of pumps used in industrial and/or well servicing systems, including, for example and without limitation, mud pumps, wastewater pumps, production fluid pumps, and other process fluid pumps. Hydraulic fracturing system 10 may include power system 14 configured to provide power to the various systems and components of hydraulic fracturing system 10. For example, power system 14 may be a power generation system including one or more gas turbines, diesel-powered engines, gas-powered engines, or other power generation components. In some embodiments, power system 14 may include a utility grid or other power source.

In some embodiments, power from power system 14 may be transferred to various components of hydraulic fracturing system 10 via a power transmission and distribution system 16, which may include switchgear system 18 and/or transformer system 20. Switchgear system 18 may be configured to isolate and protect electrical equipment of hydraulic fracturing system 10, and transformer system 20 may be configured to convert or condition electrical power such as power received from switchgear system 18 for use by components of hydraulic fracturing system 10. For example, transformer system 20 may convert power from switchgear system 18 into a useable form for systems or components of hydraulic fracturing system 10.

As shown, hydraulic fracturing system 10 may further include hydration system and/or chemical additive system (CAS) 22, which may be combined in a single unit or may be separate units. In some embodiments, hydraulic fracturing system 10 may include blender system 24 and pump system 26. Blender system 24 and pump system 26 may each receive power via power transmission and distribution system 16. Hydration system and/or CAS 22 may be configured to provide a fluid flow to blender system 24. For example, in some embodiments hydration system and/or CAS 22 may receive a flow of water and may mix the water with additives to generate a fluid of desired consistency before supplying the fluid to blender system 24. Blender system 24 may receive the flow of fluid and may mix the fluid with a proppant such as sand in a mixing chamber to create the fracturing fluid to be injected into well 12. The fracturing fluid may then be directed to pump system 26 where the pressure of the fracturing fluid may be increased to a suitable pressure for injection into well 12 during a fracturing operation.

Control system 28 of hydraulic fracturing system 10 may be configured to enable monitoring and operational control of the various systems and components of hydraulic fracturing system 10. For example, control system 28 may be positioned at a centralized location, such as a van, trailer, mobile structure, or other shelter that houses equipment to remotely monitor and control operation of hydraulic fracturing system 10 and the hydraulic fracturing process.

It should be appreciated that any of the disclosed systems may be comprised of any suitable number of units and may include any suitable components to perform the functions described above. For example, switchgear system 18, transformer system 20, hydration system and/or CAS 22, blender system 24, and/or pump system 26 may each include one or more dedicated control systems configured to regulate operation of its respective components. Additionally, the systems and components of hydraulic fracturing system 10 described above may be divided, combined, packaged, or arranged in a variety of configurations. For example, each of switchgear system 18, transformer system 20, hydration system and/or CAS 22, blender system 24, and/or pump system 26 may be positioned or arranged on one or more trucks, trailers, or skids. As an example, in some embodiments, pump system 26 may include multiple pump units. As a nonlimiting example, in some embodiments, pump system 26 may include eight pump units, each positioned on a trailer, where each unit may be configured to receive fracturing fluid from blender system 24 and where each unit may include a respective well servicing pump, motor, and control system. In such an embodiment, each unit of pump system 26 may be associated with a respective transformer unit of transformer system 20 that may be configured to provide suitable power to one of the units of pump system 26.

In accordance with present embodiments, pump system 26 may include well servicing pump 30 having magnet motor 32 configured to drive well servicing pump 30. In some embodiments, magnet motor 32 may be a permanent magnet motor. Magnet motor 32 may be integrated with and/or mounted to well servicing pump 30. In other embodiments, an alternating current (AC) induction motor may be utilized instead of magnet motor 32, in accordance with the present techniques. In the manner described below, utilizing magnet motor 32 integrated with well servicing pump 30 enables numerous benefits and improvements in operation, efficiency, transportation, and control of well servicing pump 30.

Figure 2:
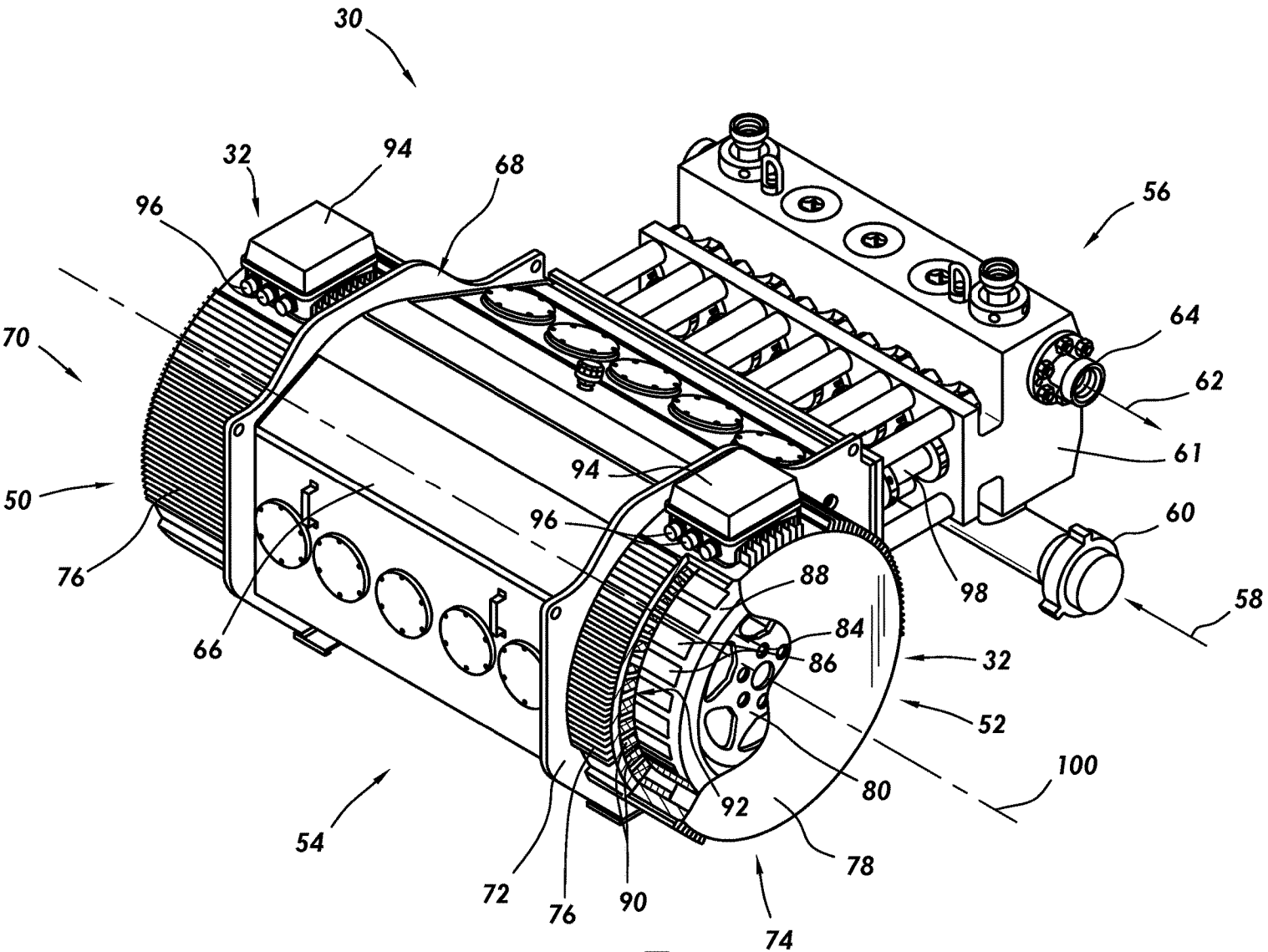
FIG. 2 is a perspective, cutaway view of an embodiment of a well servicing pump including magnet motors, in accordance with an aspect of the present disclosure.
Figure 3:
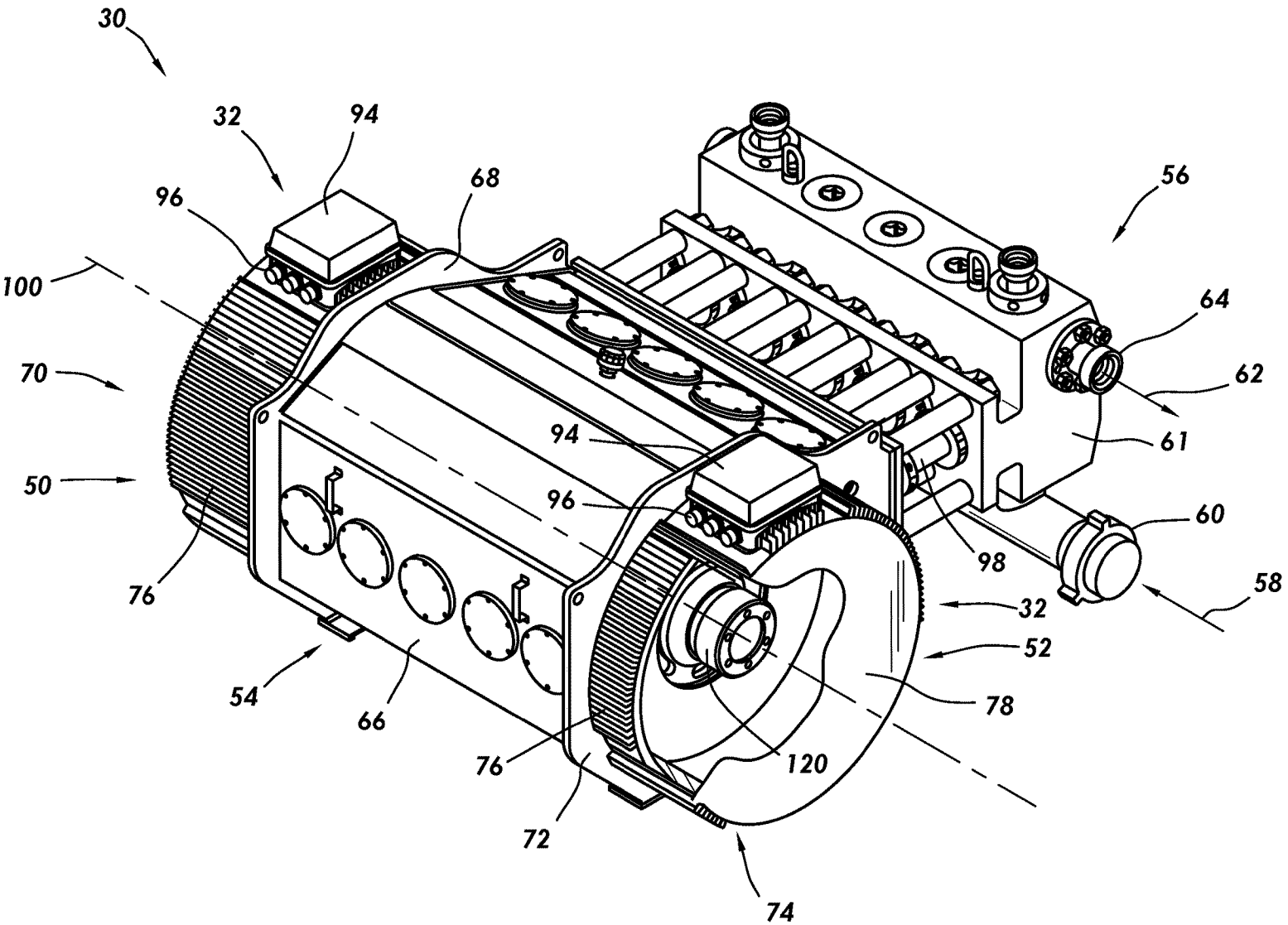
FIG. 3 is a perspective, cutaway view of an embodiment of a well servicing pump including magnet motors, in accordance with an aspect of the present disclosure.
Figure 4:
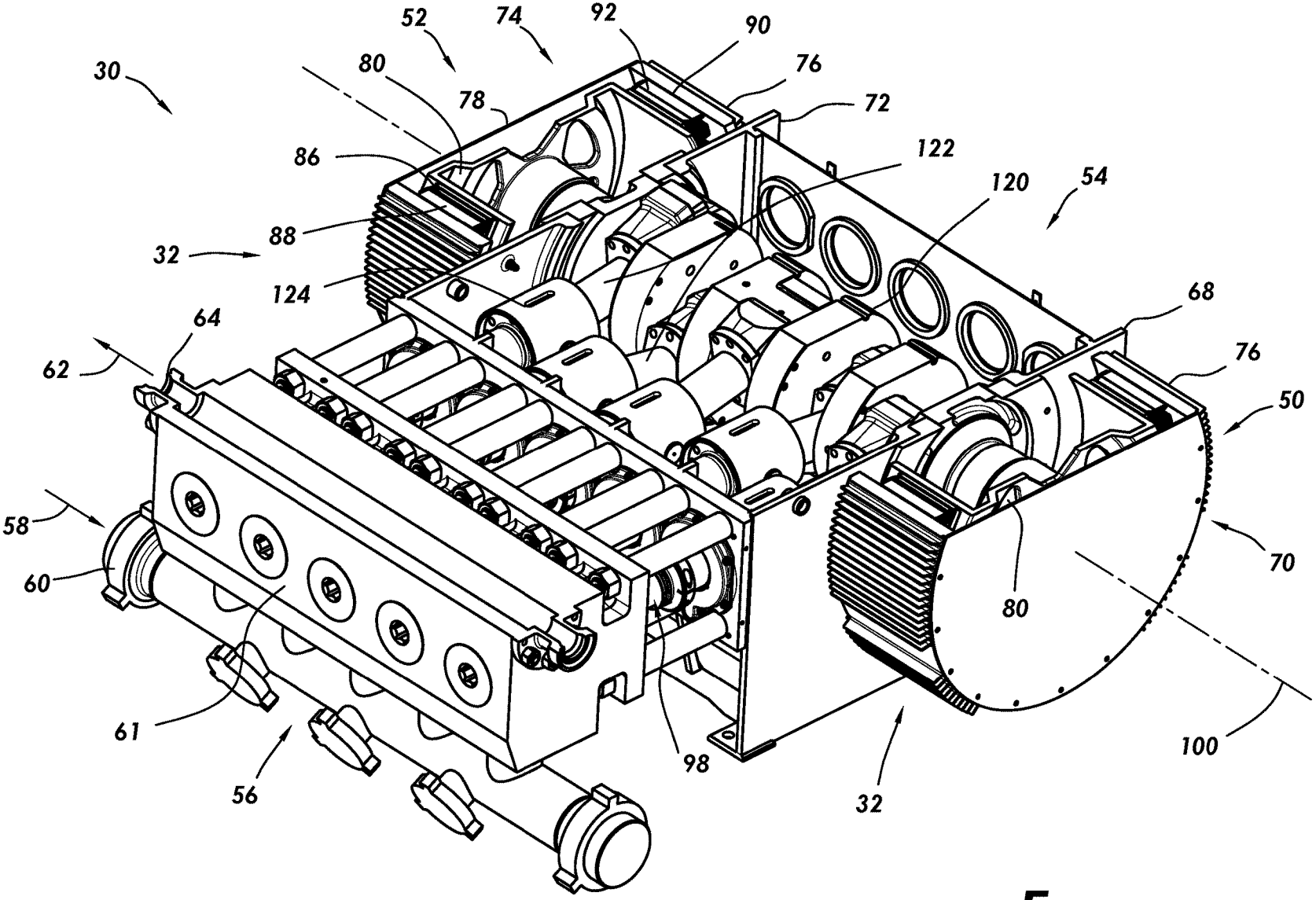
FIG. 4 is a perspective, cutaway view of an embodiment of a well servicing pump including magnet motors, in accordance with an aspect of the present disclosure.

FIGS. 2-4 depict embodiments of well servicing pump 30 having magnet motor 32. In particular, the illustrated embodiment of well servicing pump 30 includes two magnet motors 32 such as first magnet motor 50 and second magnet motor 52. Well servicing pump 30 may also include power section 54 and fluid section 56. Magnet motors 32 convert electrical energy into mechanical energy, and power section 54 transforms and provides coordinated mechanical energy to fluid section 56, which utilizes the mechanical energy to pressurize fracturing fluid. For example, fluid section 56 may draw in low-pressure fracturing fluid flow 58 via an inlet 60 of fluid section 56. The fracturing fluid may be pressurized within pressurization chamber 61 of fluid section 56, and high-pressure fracturing fluid flow 62 may be discharged via an outlet 64 of fluid section 56.

As mentioned above, well servicing pump 30 may include first and second magnet motors 50 and 52 to convert electrical energy into mechanical energy that may be transferred to power section 54. Magnet motors 32 may receive electrical power from power transmission and distribution system 16 or other component of hydraulic fracturing system 10. In the illustrated embodiment, first and second magnet motors 50 and 52 are mounted to housing 66 of well servicing pump 30. In some embodiments, first and second magnet motors 50 and 52 may be mechanically coupled to a housing of power section 54. In some embodiments, first magnet motor 50 may be mounted to housing 66 via first mounting plate or flange 72 on first side 70 of power section 54, and second magnet motor 52 may be mounted to housing 66 via second mounting plate or flange 72 on second side 74 of power section 54. In other embodiments, well servicing pump 30 may include one or more magnet motors 32 arranged in other configurations, as discussed below with reference to FIG. 5.

Each magnet motor 32 may include housing 76 and housing cover 78 containing multiple components that operate to convert electrical energy into mechanical energy in the form of rotational motion. In the illustrated embodiment, portions of housing 76 and housing cover 78 of second magnet motor 52 are removed to show internal components of magnet motor 32. For example, magnet motor 32 may include rotor 80 and stator 82 disposed about circumference 84 of rotor 80 in a concentric arrangement. Rotor 80 has plurality of magnets 86, which may be for example and without limitation permanent magnets such as rare-earth magnets, disposed generally about circumference 84 of rotor 80. In some embodiments, magnets 86 are embedded into an outer radial surface 88 of rotor 80. Stator 82 has an annular configuration and may include plurality of electrical coils 90 such as armature coils or coil windings disposed therein and circumferentially arrayed about an inner diameter 92 of stator 82.

In operation, an electric current may be applied to plurality of electrical coils 90 of stator 82 in order to generate a rotating magnetic field about circumference 84 of rotor 80. Magnet motor 32 may include junction box 94 with electrical connections 96 configured to receive electric current and direct the electric current to electrical coils 90. Application of the electric current to each of electrical coils 90 may be regulated by a controller of pump system 26 and/or well servicing pump 30, which may include a variable frequency drive (VFD), transistors, switches, and/or other suitable components configured to generate the rotating magnetic field of stator 82. The rotating magnetic field of stator 82 interacts with the magnetic fields of magnets 86. More specifically, as the rotating magnetic field of stator 82 changes position relative to the magnetic flux field of rotor 80, a magnetic torque may be generated that causes rotor 80 to rotate. In this way, magnet motor 32 converts electrical energy to mechanical energy.

The rotational motion of rotor 80 may be transferred to components of well servicing pump 30 that enable pressurization of the fracturing fluid in fluid section 56. For example, rotor 80 may be integrated with or directly coupled to crankshaft 120 as shown in FIGS. 3 and 4 disposed in power section 54 of well servicing pump 30. As shown in FIG. 4, crankshaft 120 may be coupled to connecting rods 122, each of which may be further coupled to a corresponding crosshead 124. Each crosshead 124 may further be connected to a respective plunger 98 of well servicing pump 30. As crankshaft 120 is rotated by rotor 80, the rotational motion of crankshaft 120 is converted into reciprocating motion of plungers 98 via connecting rods 122 and crossheads 124. The reciprocating motion of plungers 98 in and out of pressurization chamber 61 causes the fracturing fluid to be drawn into fluid section 56, pressurized within pressurization chamber 61, and discharged from fluid section 56 as high-pressure fracturing fluid.

The use and arrangement of magnet motor 32 with well servicing pump 30 provides several advantages over traditional well servicing pump systems. For example, rotor 80 of magnet motor 32 may be integrated with or mounted to crankshaft 120 of well servicing pump 30. Indeed, as shown in the illustrated embodiment, magnet motors 32 are integrated with and mounted to housing 66 of well servicing pump 30, such that rotors 80 of magnet motors 32 share a common axis of rotation 100 with crankshaft 120 of power section 54. As a result, well servicing pump 30 does not require a dedicated or separate transmission system such as a gearbox positioned between magnet motor 32 and crankshaft 120 to transfer mechanical energy from magnet motor 32 to crankshaft 120. This enables a reduction in the number of moving parts utilized with well servicing pump 30, which reduces operating and maintenance costs. For example, well servicing pump 30 may not include and/or may include fewer pinion shafts, pinion seals, bearings, and/or additional gears typically included in a mechanical power transmission that may be susceptible to wear, degradation, additional maintenance, repair, and/or replacement. The reduction or elimination of such components also increases the efficiency of well servicing pump 30, for example, by reducing drive-train losses. Further, the integration of magnet motors 32 to crankshaft 120 without a separate gearbox enables a reduction in the size, weight, and footprint of well servicing pump 30. The reduced size, weight, and footprint of well servicing pump 30 allows more well servicing pump 30 units to be positioned on a single truck, trailer, or skid and also increases the power density of well servicing pump 30. Presently disclosed embodiments of well servicing pump 30 and magnet motor 32 also enable a reduction in noise and/or vibration produced during operation of pump system 26.

FIG. 3 is another perspective, cutaway view of the embodiment of well servicing pump 30 having magnet motor 32 shown in FIG. 2. In the present embodiment, rotor 80, stator 82, and portions of housing 76 and housing cover 78 of second magnet motor 52 are removed to show crankshaft 120 of well servicing pump 30. As discussed in detail above, rotor 80 of second magnet motor 52 may be axially aligned along axis 100 and integrated with or mounted to crankshaft 120 to enable a more direct transfer of mechanical energy from second magnet motor 52 to crankshaft 120. As will be appreciated, rotor 80 of first magnet motor 50 may be similarly integrated with or mounted to crankshaft 120 on first side 70 of power section 54. Rotors 80 of first and second magnet motors 50 and 52 may be integrated with or mounted to crankshaft 120 via mechanical fasteners, such as bolts, a keyed engagement, or any other suitable mechanism.

Figure 5:
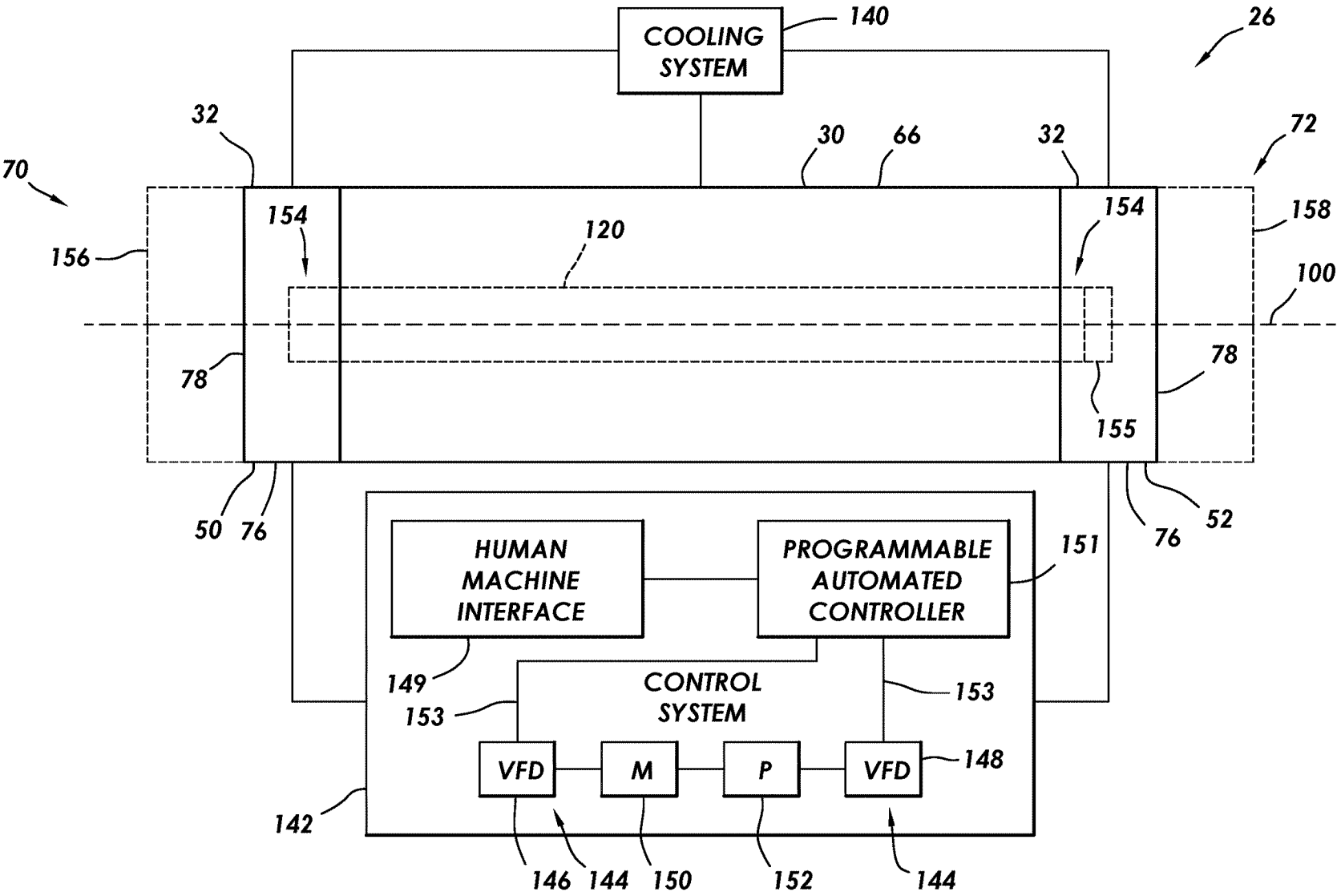
FIG. 5 is a schematic of a pump system including a well servicing pump with magnet motors, in accordance with an aspect of the present disclosure.

FIG. 5 is a schematic of an embodiment of pump system 26 illustrating various arrangements and components of pump system 26. For example, pump system 26 may include well servicing pump 30 having magnet motors 32, cooling system 140, and control system 142. In some embodiments, well servicing pump 30, cooling system 140, and control system 140 may be positioned on a common truck, trailer, or skid. Indeed, the present techniques may enable multiple pump systems 26 to be positioned on a common truck, trailer, or skid. Various possible arrangements of magnet motors 32 relative to housing 66 of well servicing pump 30 are also shown and will be discussed in further detail below.

Cooling system 140 may be configured to provide cooling and/or heat rejection for components of well servicing pump 30 and/or magnet motors 32, such as during operation of pump system 26. For example, cooling system 140 may be a liquid-based system having a pump, conduits, and/or other components configured to circulate a cooling liquid flow through one or more portions of well servicing pump 30 and/or magnet motors 32. The cooling liquid flow may absorb heat from well servicing pump 30 and/or magnet motors 32, and cooling system 140 may direct the cooling liquid flow to another location, component, or system where the heat may be removed from the cooling liquid flow to enable reuse of the cooling liquid flow for further cooling. In other embodiments, cooling system 140 may be an air-based or air-cooled system configured to reject heat from well servicing pump 30 and/or magnet motors 32 via an air flow, such as via a blower or fan. Further embodiments of cooling system 140 may include any other suitable components configured to reduce a temperature of well servicing pump 30 and/or magnet motors 32, such as a heat sink.

In some embodiments, control system 142 may include components configured to regulate operation of well servicing pump 30 and/or magnet motors 32. Control system 142 may also be configured to supply electrical power to magnet motors 32. For example, the illustrated embodiment includes VFDs 144 which may act as motor controllers configured to provide power to magnet motors 32. VFDs 144 may receive alternating current (AC) power having a particular fixed line voltage and fixed line frequency from an AC power source such as power transmission and distribution system 16 and may provide power having a variable voltage and frequency to magnet motors 32. First VFD 146 may supply power to first magnet motor 50, and second VFD 148 may supply power to second magnet motor 52. However, in other embodiments, control system 142 may include other numbers of VFDs 144 and/or other power electronics configured to drive magnet motors 32. By varying the frequency and voltage supplied to magnet motors 32, VFDs 144 may control or vary the speed and/or torque of magnet motors 32 and thus the speed and/or torque of crankshaft 120.

As shown, control system 142 may also include memory device 150 and processor 152. Processor 152 may be used to execute software, such as software for providing commands and/or data to control system 142, and so forth. Moreover, processor 152 may include multiple microprocessors, one or more "general-purpose" microprocessors, one or more special-purpose microprocessors, and/or one or more application specific integrated circuits (ASICS), or some combination thereof. For example, upon installation of the software or other executable instructions on processor 152, processor 152 may become a special purpose processor configured to improve operation of processor 152, operation of pump system 26, operation of well servicing pump 30, operation of magnet motors 32, and/or operation of control system 142 using the techniques described herein. In some embodiments, processor 152 may include one or more reduced instruction set (RISC) processors. Memory device 150 may include a volatile memory, such as RAM, and/or a nonvolatile memory, such as ROM. Memory device 150 may store a variety of information and may be used for various purposes. For example, memory device 150 may store processor-executable instructions for processor 152 to execute, such as instructions for providing commands and/or data to control system 142 and/or to components of pump system 26.

Furthermore, control system 142 may also include computer processing devices, such as one or more human machine interfaces (HMIs) 149 connected to one or more programmable automated controllers (PACs) 151, which may be a control/communication unit that is connected to VFDs 144 via one or more data cables 153 for bilateral communication. HMIs 149 relay manually-inputted commands to PACs 151, which may be used to execute software that may be stored on memory device 150, such as software for providing commands and/or data to control system 142 and/or to components of pump system 26.

As similarly described above, the illustrated embodiment of well servicing pump 30 includes first magnet motor 50 disposed on and mounted to first side 70 of well servicing pump 30 and second magnet motor 52 disposed on and mounted to second side 74 of well servicing pump 30. Thus, first and second magnet motors 52 may be directly integrated with opposite ends 154 of crankshaft 120.

Figure 6:
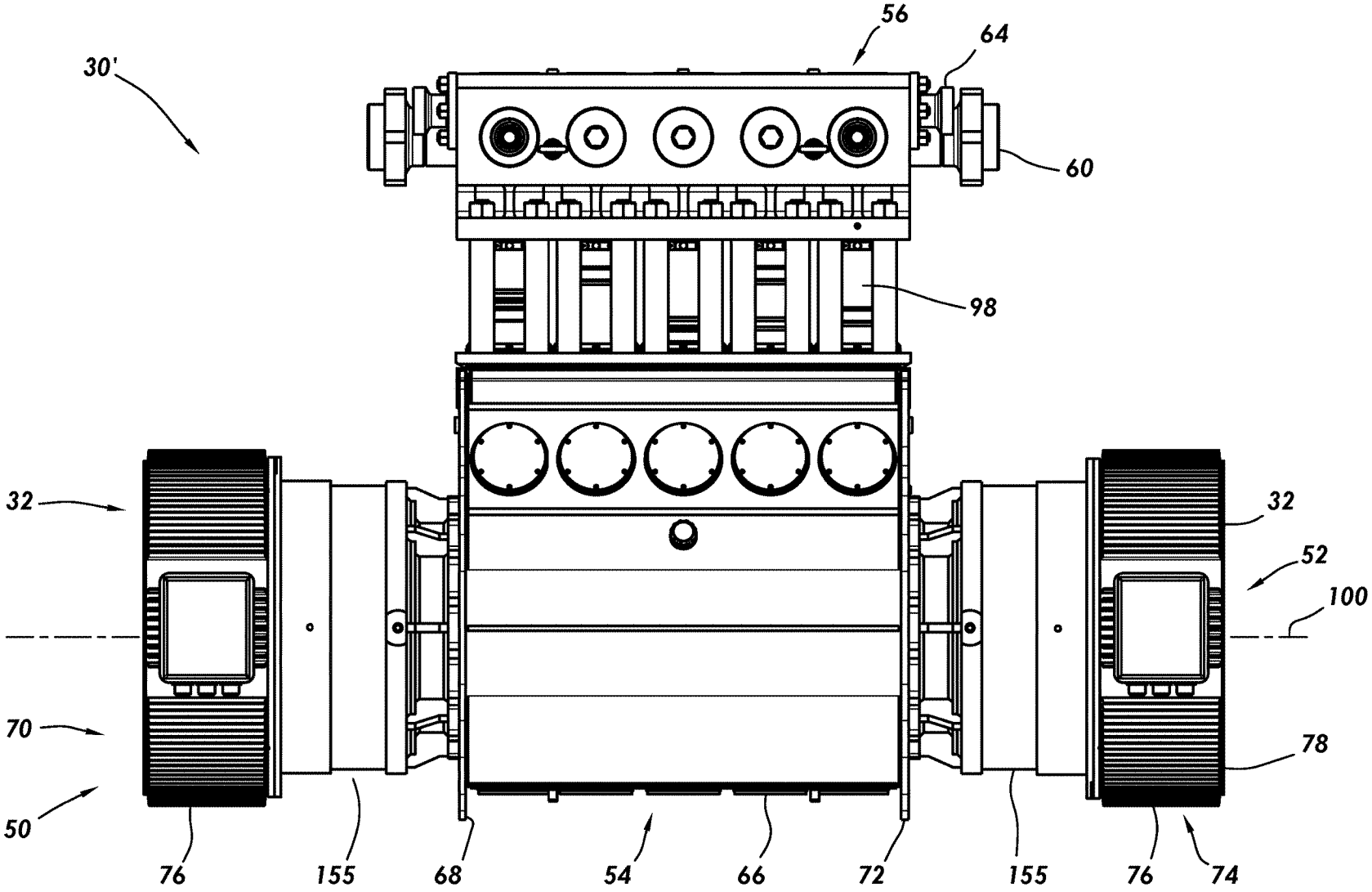
FIG. 6 is a top view of an embodiment of a well servicing pump including magnet motors, in accordance with an aspect of the present disclosure.
Figure 7:
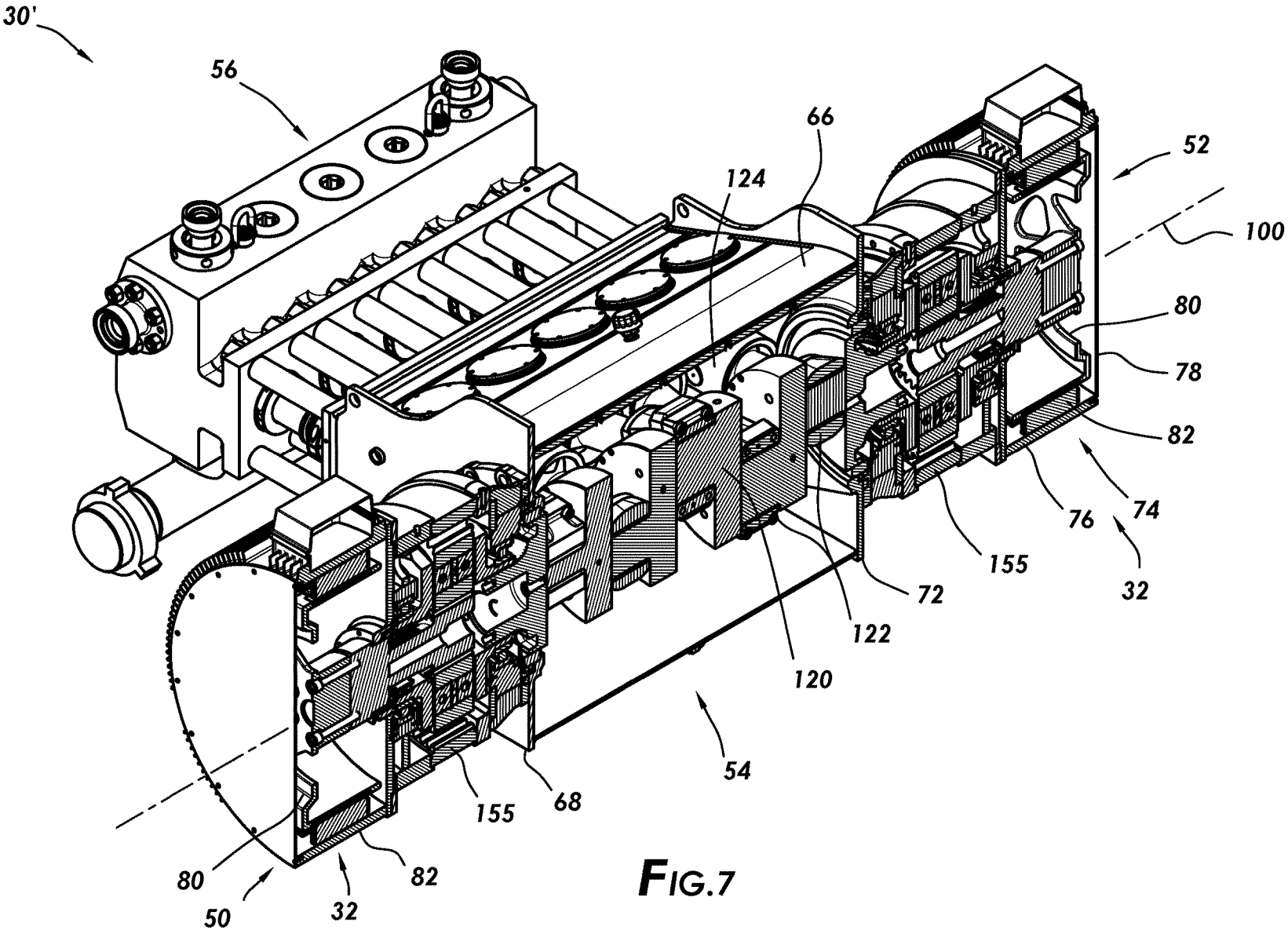
FIG. 7 is a perspective, cutaway view of an embodiment of a well servicing pump including magnet motors, in accordance with an aspect of the present disclosure.

In other embodiments, well servicing pump 30' may include one or more gears such as gearboxes 155 integrated with crankshaft 120 and magnet motor 32 as shown in FIGS. 6 and 7 to achieve a desired torque on crankshaft 120. Gearboxes 155 may be aligned with crankshaft 120 and/or magnet motor 32 along the common axis of rotation 100 to improve efficiency of well servicing pump 30'. Although gearboxes 155 are depicted in FIG. 7 as planetary gearboxes, one of ordinary skill in the art with the benefit of this disclosure will understand that any suitable gearbox design may be used without deviating from the scope of this disclosure.

With magnet motor 32 arrangement described above, operation of magnet motors 32 may be physically and electrically synchronized. Magnet motors 32 are physically synchronized via common connection to crankshaft 120, and operation of magnet motors 32 may be electrically synchronized via operation of control system 142 including, in some embodiments, VFDs 144. As will be appreciated, operation of VFDs 144 may be coordinated to enable balancing of well servicing pump 30 load across magnet motors 32 in a desirable manner. Load balancing between multiple magnet motors 32 driving well servicing pump 30 via VFDs 144 may also allow for harmonic mitigation, which may reduce heating of electrical components in pump system 26. VFDs 144 may further control operation of magnet motors 32 based on readings received from sensors of pump system 26 or according to sensor-less control algorithms, which may be stored in memory device 150, in order to achieve desired operation of well servicing pump 30.

Figure 8:
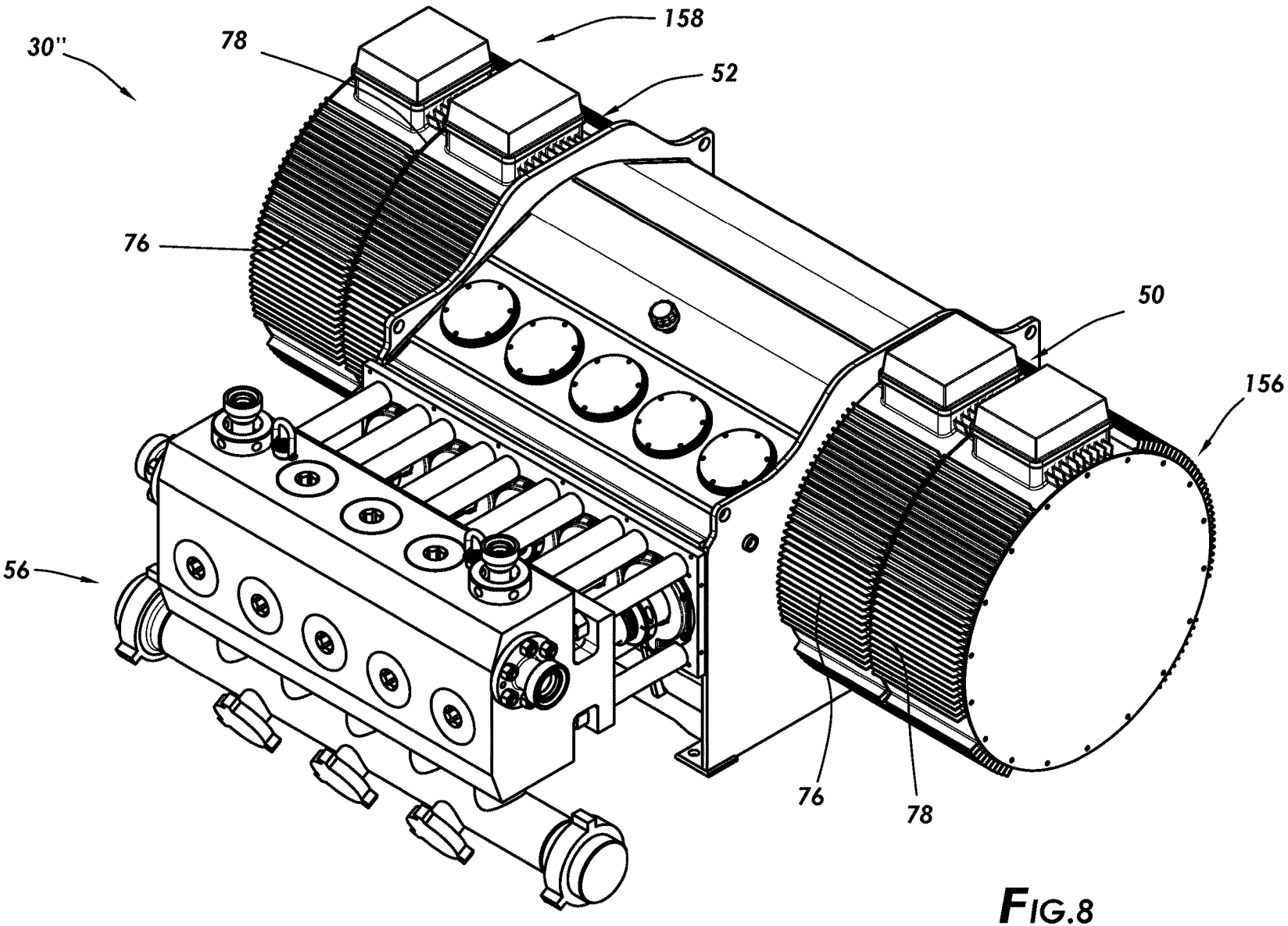
FIG. 8 is a perspective view of an embodiment of a well servicing pump including magnet motors, in accordance with an aspect of the present disclosure.

While the illustrated embodiment of well servicing pump 30 includes first magnet motor 50 disposed on and integrated with first side 70 of well servicing pump 30 and second magnet motor 52 disposed on and integrated with second side 74 of well servicing pump 30, other arrangements of magnet motors 32 with well servicing pump 30 may be utilized. For example, FIG. 8 depicts well servicing pump 30" that includes an additional magnet motor 156 disposed on first side 70 of well servicing pump 30" adjacent to first magnet motor 50. In such an embodiment, additional magnet motor 156 may be mounted to housing 76 and/or housing cover 78 of first magnet motor 50 and may further be integrated with or directly coupled to crankshaft 120. Additional magnet motor 156 may be included in addition to or instead of second magnet motor 52. Similarly, an additional magnet motor 158 may be disposed on second side 74 of well servicing pump 30" adjacent to second magnet motor 52 and may be mounted to housing 76 and/or housing cover 78 of second magnet motor 52. Additional magnet motor 158 may be included in addition to or instead of first magnet motor 50 and/or additional magnet motor 156. It should be appreciated that any suitable number and arrangement of magnet motors 32 may be utilized with well servicing pump 30 to drive rotation of crankshaft 120.

The foregoing outlines features of several embodiments so that a person of ordinary skill in the art may better understand the aspects of the present disclosure. Such features may be replaced by any one of numerous equivalent alternatives, only some of which are disclosed herein. One of ordinary skill in the art should appreciate that they may readily use the present disclosure as a basis for designing or modifying other processes and structures for carrying out the same purposes and/or achieving the same advantages of the embodiments introduced herein. One of ordinary skill in the art should also realize that such equivalent constructions do not depart from the spirit and scope of the present disclosure and that they may make various changes, substitutions, and alterations herein without departing from the spirit and scope of the present disclosure.

The invention claimed is:

1. A hydraulic fracturing system comprising:

a hydration system;

a blender system, the blender system configured to receive a fluid flow from the hydration system; and a well servicing pump, the well servicing pump including:

a first permanent magnet motor, the first permanent magnet motor including a first rotor;

a second permanent magnet motor, the second permanent magnet motor including a second rotor;

a crankshaft positioned in a power section;

a first gearbox, the first gearbox operatively coupled between the first rotor of the first permanent magnet motor and the crankshaft at a first end of the crankshaft;

a second gearbox, the second gearbox operatively coupled between the second rotor of the second permanent magnet motor and the crankshaft at a second end of the crankshaft;

a third permanent magnet motor, the third permanent magnet motor including a third rotor, the third permanent magnet motor positioned adjacent to and abutting the first permanent magnet motor, the third rotor is mechanically coupled to the first rotor, the first gearbox, and the crankshaft such that the third rotor is directly coupled to the first rotor and such that rotation of the third rotor is coaxial with the rotation of the first rotor;

a fluid section, the fluid section including an inlet, a pressurization chamber, and an outlet, the inlet and outlet fluidly coupled to the pressurization chamber; and a plunger, the plunger mechanically coupled to the crankshaft, the plunger at least partially positioned within the pressurization chamber;

wherein the inlet of the fluid section of the well servicing pump is configured to receive fracturing fluid from the blender system; and wherein the outlet of the fluid section is fluidly coupled to a well.

2. The hydraulic fracturing system of claim 1, wherein the power section comprises a housing, and the first and second permanent magnet motors are mounted to the housing.

3. The hydraulic fracturing system of claim 2, wherein:

the first permanent magnet motor comprises a first stator and a first housing positioned about the first rotor;

the second permanent magnet motor comprises a second stator and a second housing positioned about the second rotor; and wherein the first housing and second housing are mechanically coupled to the housing of the power section, positioned about the crankshaft.

4. The hydraulic fracturing system of claim 3, wherein the permanent magnet motor comprises a plurality of coil windings circumferentially arrayed about the stator and a plurality of magnets circumferentially arrayed about the rotor.

5. The hydraulic fracturing system of claim 1, comprising a variable frequency drive configured to provide electrical energy to the first permanent magnet motor.

6. The hydraulic fracturing system of claim 1, further comprising a cooling system, the cooling system including a liquid-based system configured to circulate a cooling liquid flow through at least one of the first and second permanent magnet motors.

7. A well servicing pump system comprising:

a first permanent magnet motor, the first permanent magnet motor including a first rotor;

a second permanent magnet motor, the second permanent magnet motor including a second rotor;

a crankshaft;

a first gearbox, the first gearbox operatively coupled between the first rotor of the first permanent magnet motor and the crankshaft at a first end of the crankshaft;

a second gearbox, the second gearbox operatively coupled between the second rotor of the second permanent magnet motor and the crankshaft at a second end of the crankshaft;

a third permanent magnet motor, the third permanent magnet motor including a third rotor, the third permanent magnet motor positioned adjacent to and abutting the first permanent magnet motor, the third rotor is mechanically coupled to the first rotor, the first gearbox, and the crankshaft such that the third rotor is directly coupled to the first rotor and such that rotation of the third rotor is coaxial with the rotation of the first rotor;

a fluid section, the fluid section including an inlet, a pressurization chamber, and an outlet, the inlet and outlet fluidly coupled to the pressurization chamber; and a plunger, the plunger mechanically coupled to the crankshaft, the plunger at least partially positioned within the pressurization chamber.

8. The well servicing pump system of claim 7, further comprising a power section, wherein the power section comprises a housing, and the first and second permanent magnet motors and first and second gearboxes are mounted to the housing.

9. The well servicing pump system of claim 8, wherein:

the first permanent magnet motor comprises a first stator and a first housing positioned about the first rotor;

the second permanent magnet motor comprises a second stator and a second housing positioned about the second rotor; and wherein the first housing and second housing are mechanically coupled to the housing of the power section, positioned about the crankshaft via the first and second gearboxes, respectively.

10. The well servicing pump system of claim 9, wherein the permanent magnet motor comprises a plurality of coil windings circumferentially arrayed about the stator and a plurality of magnets circumferentially arrayed about the rotor.

11. The well servicing pump system of claim 7, comprising a variable frequency drive configured to provide electrical energy to the first permanent magnet motor.

12. The well servicing pump system of claim 7, further comprising a cooling system, the cooling system including a liquid-based system configured to circulate a cooling liquid flow through at least one of the first and second permanent magnet motors.

* * * * *